US007910538B2

(12) United States Patent
Tang et al.

(10) Patent No.: US 7,910,538 B2
(45) Date of Patent: Mar. 22, 2011

(54) DETERGENT COMPOSITION

(75) Inventors: Ming Tang, Beijing (CN); Qing Chen, Beijing (CN); Sen Liu, Beijing (CN); Kenneth Nathan Price, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 12/477,962

(22) Filed: Jun. 4, 2009

(65) Prior Publication Data

US 2009/0305939 A1 Dec. 10, 2009

Related U.S. Application Data

(60) Provisional application No. 61/130,944, filed on Jun. 4, 2008.

(51) Int. Cl.
*C11D 17/00* (2006.01)

(52) U.S. Cl. ..... 510/424; 510/425; 510/426; 510/428; 510/429; 510/431

(58) Field of Classification Search ..... None
See application file for complete search history.

(56) References Cited

U.S. PATENT DOCUMENTS

| | | | |
|---|---|---|---|
| 4,228,042 | A | 10/1980 | Letton |
| 4,239,660 | A | 12/1980 | Kingry |
| 4,260,529 | A | 4/1981 | Letton |
| 4,430,243 | A | 2/1984 | Bragg |
| 4,483,779 | A | 11/1984 | Llenado et al. |
| 4,483,780 | A | 11/1984 | Llenado |
| 4,565,647 | A | 1/1986 | Llenado |
| 5,332,528 | A | 7/1994 | Pan |
| 5,576,282 | A | 11/1996 | Miracle et al. |
| 5,595,967 | A | 1/1997 | Miracle et al. |
| 5,597,936 | A | 1/1997 | Perkins et al. |
| 6,004,922 | A | 12/1999 | Watson et al. |
| 6,020,303 | A | 2/2000 | Cripe et al. |
| 6,022,844 | A | 2/2000 | Baillely et al. |
| 6,093,856 | A | 7/2000 | Cripe et al. |
| 6,136,769 | A | 10/2000 | Asano et al. |
| 6,150,322 | A | 11/2000 | Singleton et al. |
| 6,153,577 | A | 11/2000 | Cripe et al. |
| 6,221,825 | B1 | 4/2001 | Williams, Jr. et al. |
| 6,225,464 | B1 | 5/2001 | Hiler, II et al. |
| 6,306,812 | B1 | 10/2001 | Perkins et al. |
| 6,326,348 | B1 | 12/2001 | Vinson et al. |
| 6,482,994 | B2 | 11/2002 | Scheper et al. |

FOREIGN PATENT DOCUMENTS

| | | | |
|---|---|---|---|
| EP | 0 888 449 | B1 | 12/2001 |
| WO | WO 92/06162 | A1 | 4/1992 |
| WO | WO 93/19038 | A1 | 9/1993 |
| WO | WO 93/19146 | A1 | 9/1993 |
| WO | WO 94/09099 | A1 | 4/1994 |
| WO | WO 98/20105 | A1 | 5/1998 |
| WO | WO 98/35002 | A1 | 8/1998 |
| WO | WO 98/35003 | A1 | 8/1998 |
| WO | WO 98/35004 | A1 | 8/1998 |
| WO | WO 98/35005 | A1 | 8/1998 |
| WO | WO 98/35006 | A1 | 8/1998 |
| WO | WO 00/18856 | A1 | 4/2000 |
| WO | WO 00/47708 | A1 | 8/2000 |
| WO | WO 00/32601 | A3 | 10/2000 |
| WO | WO 01/42408 | A3 | 6/2001 |
| WO | WO 2005/042532 | A1 | 5/2005 |

OTHER PUBLICATIONS

International Search Report, 6 Pages.

*Primary Examiner* — Necholus Ogden, Jr.
(74) *Attorney, Agent, or Firm* — Julie A. Mcconihay; Leonard W. Lewis; Steven W. Miller

(57) ABSTRACT

A detergent composition comprising at most 15% by weight of phosphate builder(s) and aluminosilicate builder(s), and comprising at least one short chain anionic surfactant selected from alkyl sulfate surfactant(s) and alkyl sulfonate surfactants.

17 Claims, No Drawings

DETERGENT COMPOSITION

CROSS REFERENCE TO RELATED APPLICATIONS

This application claims the benefit of U.S. Provisional Application No. 61/130,944 filed Jun. 4, 2008.

FIELD OF THE INVENTION

The present invention concerns detergent compositions having satisfying sudsing and cleaning properties. The composition comprises a low level of inorganic builders such as aluminosilicate builder and phosphate builder and a specific surfactant system.

BACKGROUND OF THE INVENTION

Anionic surfactants, such alkyl sulfonates or alkyl sulfates, are known for their cleaning detergent properties and, accordingly, have been used for years in detergent compositions to remove the soil of a substrate during a wash. Typically due to the process to obtain them, alkyl sulfonates and alkyl sulfates may be available under the form of a mixture of surfactants with different chain length.

It is usually accepted that alkyl sulfates and alkyl sulfonates having a longer chain length are providing better cleaning performance than shorter chain length surfactants. For example, $C_{16-18}$ alkyl sulfates surfactants are usually recognized as providing better cleaning performance than $C_{8-15}$ alkyl sulfates.

In addition to their cleaning properties, the detergent compositions should also have satisfying sudsing properties. Consumers usually associate good sudsing properties with good cleaning properties. However, the use of surfactants providing good sudsing properties may be detrimental to the effective cleaning properties of the composition. As such, there is a need for detergent composition providing both satisfying sudsing and cleaning properties.

The inventors have now found that a specific surfactant system in the detergent composition of the invention could deliver improved sudsing property while not substantially lowering, or even while maintaining, or even while substantially improving, the cleaning properties of the composition.

SUMMARY OF THE INVENTION

In an embodiment of the present invention, the invention concerns a detergent composition comprising at most 15% by weight of phosphate builder(s) and aluminosilicate builder(s), and comprising at least one alkyl sulfate surfactant(s) of formula $R_1$—O—$SO_3^-M^+$, wherein the total amount of alkyl sulfate surfactant(s) of formula $R_1$—O—$SO_3^-M^+$ in the detergent composition comprises from 85 to 100% by weight of alkyl sulfate surfactant(s) of formula $R_3$—O—$SO_3^-M^+$.

In an embodiment of the present invention, the invention concerns a detergent composition comprising at most 15% by weight of phosphate builder(s) and aluminosilicate builder(s), and comprising at least one alkyl sulfonate surfactant(s) of formula $R_2$-Ph-$SO_3^-M^+$, wherein the total amount of alkyl sulfonate surfactant(s) of formula $R_2$-Ph-$SO_3^-M^+$ in the detergent composition comprises from 75 to 100% by weight of alkyl sulfonate surfactant(s) of formula $R_4$-Ph-$SO_3^-M^+$.

In an embodiment of the present invention, the invention concerns a detergent composition comprising at most 15% by weight of phosphate builder(s) and aluminosilicate builder(s), and comprising at least one alkyl sulfonate surfactant(s) of formula $R_1$—O—$SO_3^-M^+$, wherein the total amount of alkyl sulfonate surfactant(s) of formula $R_1$—O—$SO_3^-M^+$ in the detergent composition comprises from 85 to 100% by weight of alkyl sulfonate surfactant(s) of formula $R_3$—$SO_3^-M^+$.

In the above formulas, $R_1$ is a linear or branched, substituted or unsubstituted, optionally alkoxylated, alkyl comprising from 8 to 18 carbon atoms, $R_2$ is a linear or branched, substituted or unsubstituted, optionally alkoxylated, alkyl comprising from 8 to 15 carbon atoms, $R_3$ is a linear or branched, substituted or unsubstituted, optionally alkoxylated, alkyl comprising from 8 to 15 carbon atoms, $R_4$ is a linear or branched, substituted or unsubstituted, optionally alkoxylated, alkyl comprising from 8 to 12 carbon atoms, $M^+$, identical or different, is a proton or a cation which provides charge neutrality, and Ph is a phenyl group optionally substituted.

DETAILED DESCRIPTION OF THE INVENTION

Surfactant System

The detergent composition of the invention comprises a surfactant system constituted of surfactant(s).

The detergent composition may comprise from 1 to 90% by weight of the composition of a surfactant system. In particular, the composition comprises from 2 to 50, typically from 4 to 30, for example from 6 to 25 or from 8 to 20% by weight of a surfactant system. The composition may comprise less than 18%, for example less than 15% or 12%, or even less than 10% by weight of a surfactant system.

The detergent composition comprises at least one alkyl sulfate surfactant(s) of formula $R_1$—O—$SO_3^-M^+$, and/or at least one alkyl sulfonate surfactant(s) of formula $R_2$-Ph-$SO_3^-M^+$, and/or at least one alkyl sulfonate surfactant(s) of formula $R_1$—$SO_3^-M^+$, with $R_1$, $R_2$, Ph, and $M^+$ being as defined above.

$M^+$ may be a proton or a cation such as a sodium, calcium, potassium, or magnesium cation, in particular a sodium cation.

Alkyl Sulfate Surfactant(s) of Formula $R_1$—O—$SO_3^-M^+$

The detergent composition of the invention may comprise alkyl sulfate surfactant(s) of formula $R_1$—O—$SO_3^-M^+$, with $R_1$ being a linear or branched, substituted or unsubstituted, optionally alkoxylated, alkyl comprising from 8 to 18 carbon atoms, $M^+$, identical or different, being a proton or a cation which provides charge neutrality.

The detergent composition may comprise from 0.1 to 50%, for example from 0.3 to 10%, typically from 0.4 to 8%, or from 0.5 to 6% by weight of alkyl sulfate surfactant(s) of formula $R_1$—O—$SO_3^-M^+$.

The detergent composition of the invention may comprises alkyl sulfate surfactant(s) of formula $R_3$—O—$SO_3^-M^+$, with $R_3$ being a linear or branched, typically linear, substituted or unsubstituted, typically unsubstituted, optionally alkoxylated, alkyl comprising from 8 to 15 carbon atoms and with $M^+$ being a proton or a cation which provides charge neutrality.

The composition may comprise from 0.1 to 50%, for example from 0.3 to 10%, typically from 0.4 to 8%, or from 0.5 to 6% by weight of alkyl sulfate surfactant(s) of formula $R_3$—O—$SO_3^-$ $M^+$.

In the detergent composition of the invention, the alkyl sulfate surfactant(s) of formula $R_1$—O—$SO_3^-M^+$, may comprise from 85% to 100% by weight of alkyl sulfate surfactant(s) of formula $R_3$—O—$SO_3^-M^+$. In the detergent composition of the invention, typically, the alkyl sulfate surfactant(s) of formula $R_1$—O—$SO_3^-M^+$, comprises from 90 to 100%, in particular at least 92% or 94%, typically at least 96% or 98%, by weight of alkyl sulfate surfactant(s) of formula $R_3$—O—$SO_3^-$ $M^+$.

In the composition of the invention, the alkyl sulfate surfactant(s) of formula $R_1$—O—$SO_3^-$ $M^+$, may comprise from 30% to 100%, for example from 50 to 99%, typically from 60 to 95%, or from 65 to 90%, or even from 70 to 80% by weight of alkyl sulfate surfactant(s) of formula $R_{12}$—O—$SO_3^-M^+$, with $R_{12}$ being a linear or branched, typically linear, substituted or unsubstituted, typically unsubstituted, optionally alkoxylated, $C_{12}$ alkyl and with $M^+$ being a proton or a cation which provides charge neutrality.

In the detergent composition of the invention, part or all of the alkyl sulfate surfactant(s), for example from 10 to 99% or from 20 to 80% or from 30 to 70% by weight of the alkyl sulfate surfactant(s), of formula $R_1$—O—$SO_3^-M^+$ or $R_3$—O—$SO_3^-M^+$ or $R_{12}$—O—$SO_3^-M^+$ may be alkoxylated. The compositions of the invention may comprise both non alkoxylated and alkoxylated alkyl sulfate surfactants. The compositions may comprise at least two alkoxylated sulfate surfactant(s) alkoxylated with different degree of alkoxylation. The alkoxylated alkyl sulfate surfactant(s) may be alkoxylated with 0.1 to 9 moles or from 0.1 to 5, or from 0.2 to 3, typically from 0.3 to 1.5 of $C_{1-4}$ alkylene oxide per mole of alkyl sulfate.

Typically, the alkyl sulfate surfactant(s) of formula $R_1$—O—$SO_3^-M^+$ or $R_3$—O—$SO_3^-$ $M^+$ may be derived from palm kernel oil or coconut oil. Palm kernel oil and coconut oil usually comprises triglycerides which can be chemically processed to obtain a mixture of $C_{12}$-$C_{18}$ alcohols which usually comprise more than 20% of $C_{16}$-$C_{18}$ alcohols. The alcohols may be sulfated to obtain alkyl sulfates. A mixture of alkyl sulfates comprising a lower proportion of $C_{16}$-$C_{18}$ alkyl sulfates may be obtained by separating the corresponding alcohols before the sulfatation step or by separating the obtained alkyl sulfate surfactant(s) after the sulfatation step.

A suitable alkyl sulfate surfactant(s) is Texapon v95 by Cognis.

Alkyl Sulfonate Surfactant(s) of Formula $R_2$-Ph-$SO_3^-M^+$

The detergent composition of the invention may comprise alkyl sulfonate surfactant(s) of formula $R_2$-Ph-$SO_3^-M^+$, with $R_2$ being a linear or branched, substituted or unsubstituted, optionally alkoxylated, alkyl comprising from 8 to 15 carbon atoms, $M^+$, identical or different, being a proton or a cation which provides charge neutrality.

The detergent composition may comprise from 0.1 to 50%, for example from 0.5 to 20%, typically from 1 to 12%, or from 2 to 8% by weight of alkyl sulfonate surfactant(s) of formula $R_2$-Ph-$SO_3^-M^+$.

The detergent composition of the invention may comprises alkyl sulfonate surfactant(s) of formula $R_4$-Ph-$SO_3^-M^+$, with $R_4$ being a linear or branched, typically linear, substituted or unsubstituted, typically unsubstituted, optionally alkoxylated, alkyl comprising from 8 to 12 carbon atoms and with $M^+$ being a proton or a cation which provides charge neutrality.

The composition may comprise from 0.1 to 50%, for example from 0.5 to 20%, typically from 1 to 12%, or from 2 to 8% by weight of alkyl sulfonate surfactant(s) of formula $R_4$-Ph-$SO_3^-$ $M^+$.

In the detergent composition of the invention, the alkyl sulfonate surfactant(s) of formula $R_2$-Ph-$SO_3^-M^+$, may comprise from 75% to 100% by weight of alkyl sulfonate surfactant(s) of formula $R_4$-Ph-$SO_3^-M^+$. In the detergent composition of the invention, typically, the alkyl sulfonate surfactant(s) of formula $R_2$-Ph-$SO_3^-M^+$, comprises from 80 to 100%, in particular at least 85% or 90%, typically at least 95% or 98%, by weight of alkyl sulfonate surfactant(s) of formula $R_4$-Ph-$SO_3^-M^+$.

Ph represents a phenyl group. Typically, Ph is an optionally substituted benzyl group. Typically, the alkyl sulfonate surfactant(s) of formula $R_2$-Ph-$SO_3^-M^+$ or $R_4$-Ph-$SO_3^-$ $M^+$ is an alkyl benzene sulfonate.

Typically, the alkyl sulfonate surfactant(s) of formula $R_4$-Ph-$SO_3^-M^+$ are obtained by Friedel-Crafts alkylation to produce Linear Alkyl Benzene (LAB), which is then sulfonated.

Alkyl Sulfonate Surfactant(s) of Formula $R_1$—$SO_3^-M^+$

The detergent composition of the invention may comprise alkyl sulfonate surfactant(s) of formula $R_1$—$SO_3^-M^+$, with $R_1$ being a linear or branched, substituted or unsubstituted, optionally alkoxylated, alkyl comprising from 8 to 18 carbon atoms, $M^+$, identical or different, being a proton or a cation which provides charge neutrality.

The detergent composition may comprise from 0.1 to 50%, for example from 0.3 to 10%, typically from 0.4 to 8%, or from 0.5 to 6% by weight of alkyl sulfonate surfactant(s) of formula $R_1$—$SO_3^-M^+$.

The detergent composition of the invention may comprises alkyl sulfonate surfactant(s) of formula $R_3$—$SO_3^-M^+$, with $R_3$ being a linear or branched, typically linear, substituted or unsubstituted, typically unsubstituted, optionally alkoxylated, alkyl comprising from 8 to 15 carbon atoms and with $M^+$ being a proton or a cation which provides charge neutrality.

The composition may comprise from 0.1 to 50%, for example from 0.3 to 10%, typically from 0.4 to 8%, or from 0.5 to 6% by weight of alkyl sulfonate surfactant(s) of formula $R_3$—$SO_3^-$ $M^+$.

In the detergent composition of the invention, the alkyl sulfonate surfactant(s) of formula $R_1$—$SO_3^-M^+$, may comprise from 85% to 100% by weight of alkyl sulfonate surfactant(s) of formula $R_3$—$SO_3^-M^+$. In the detergent composition of the invention, typically, the alkyl sulfonate surfactant(s) of formula $R_1$—$SO_3^-M^+$, comprises from 90 to 100%, in particular at least 92% or 94%, typically at least 96% or 98%, by weight of alkyl sulfonate surfactant(s) of formula $R_3$—$SO_3^-$ $M^+$.

Other Surfactant of the Surfactant System

In addition to the sulfated and/or sulfonated anionic surfactant(s) of the invention, the detergent composition may comprise one or more additional surfactant(s). The additional surfactant(s) may be selected from nonionic surfactants, other anionic surfactants, cationic surfactants, ampholytic surfactants, zwitterionic surfactants, semi-polar nonionic surfactants and mixtures thereof.

ANIONIC SURFACTANT—The compositions of the invention may comprise additional anionic surfactants which typically comprise one or more moieties selected from the group consisting of carbonate, phosphate, phosphonate, sulfate, sulfonate, carboxylate and mixtures thereof. Typically, the detergent composition comprises from 1 to 50 wt % anionic surfactant, more typically from 2 to 40 wt % or from 3 to 30% or for 4 to 20% or from 5 to 15% or from 6 to 12% of anionic surfactant(s).

NON-IONIC SURFACTANT—The compositions of the invention may comprise non-ionic surfactant. Where present the non-ionic detersive surfactant(s) is generally present in amounts of from 0.5 to 20wt %, or from 2wt % to 4wt %.

The non-ionic detersive surfactant can be selected from the group consisting of: alkyl polyglucoside and/or an alkyl alkoxylated alcohol; $C_{12}$-$C_{18}$ alkyl ethoxylates, such as, NEODOL® non-ionic surfactants from Shell; $C_6$-$C_{12}$ alkyl phenol alkoxylates wherein the alkoxylate units are ethyleneoxy units, propyleneoxy units or a mixture thereof; $C_{12}$-$C_{18}$ alcohol and $C_6$-$C_{12}$ alkyl phenol condensates with ethylene oxide/propylene oxide block polymers such as Pluronic® from BASF; $C_{14}$-$C_{22}$ mid-chain branched alcohols, BA, as described in more detail in U.S. Pat. No. 6,150,322; $C_{14}$-$C_{22}$ mid-chain branched alkyl alkoxylates, BAEx, wherein x=from 1 to 35, as described in more detail in U.S. Pat. No. 6,153,577, U.S. Pat. No. 6,020,303 and U.S. Pat. No. 6,093,856; alkylcelluloses as described in more detail in U.S. Pat. No. 4,565,647, specifically alkylpolyglycosides as described in more detail in U.S. Pat. No. 4,483,780 and U.S. Pat. No. 4,483,779; polyhydroxy fatty acid amides as described in more detail in U.S. Pat. No. 5,332,528, WO 92/06162, WO 93/19146, WO 93/19038, and WO 94/09099; ether capped poly(oxyalkylated) alcohol surfactants as described in more detail in U.S. Pat. No. 6,482,994 and WO 01/42408; and mixtures thereof.

CATIONIC SURFACTANT—The composition may comprise a cationic surfactant. When present, typically the composition comprises from 0.05 wt % to 10 wt %, or from 0.1 wt % to 2 wt % cationic surfactant.

Suitable cationic surfactants are alkyl pyridinium compounds, alkyl quaternary ammonium compounds, alkyl quaternary phosphonium compounds, and alkyl ternary sulfonium compounds. The cationic detersive surfactant can be selected from the group consisting of: alkoxylate quaternary ammonium (AQA) surfactants as described in more detail in U.S. Pat. No. 6,136,769; dimethyl hydroxyethyl quaternary ammonium surfactants as described in more detail in U.S. Pat. No. 6,004,922; polyamine cationic surfactants as described in more detail in WO 98/35002, WO 98/35003, WO 98/35004, WO 98/35005, and WO 98/35006; cationic ester surfactants as described in more detail in U.S. Pat. No. 4,228,042, U.S. Pat. No. 4,239,660, U.S. Pat. No. 4,260,529 and U.S. Pat. No. 6,022,844; amino surfactants as described in more detail in U.S. Pat. No. 6,221,825 and WO 00/47708, specifically amido propyldimethyl amine; and mixtures thereof.

Highly preferred cationic surfactants are mono-$C_{8-10}$ alkyl mono-hydroxyethyl di-methyl quaternary ammonium chloride, mono-$C_{10-12}$ alkyl mono-hydroxyethyl di-methyl quaternary ammonium chloride and mono-$C_{10}$ alkyl mono-hydroxyethyl di-methyl quaternary ammonium chloride. Cationic surfactants such as Praepagen HY (tradename Clariant) may be useful and may also be useful as a suds booster.

Builder

The detergent composition may comprise one or more builders. When a builder is used, the subject composition will typically comprise from 1% to about 40%, typically from 2 to 25%, or even from about 5% to about 20%, or from 8 to 15% by weight of builder.

The detergent composition comprises at most 15% by weight of phosphate builder(s) and aluminosilicate builder(s), for example from 0 to 12% by weight of phosphate builder(s) and aluminosilicate builder(s). The detergent composition may comprises at most 10% or 9% or 8% or 7% or 6% or less than 5%, 4% or 3% or even less than 2% or 1% by weight of phosphate builder(s) and aluminosilicate builder(s)

The detergent compositions of the present invention may comprise less than 12% or 10%, for example less than 5% or 4% or 3% or 2% or 1% of zeolite. In particular, the detergent composition comprises less than 12% or 10%, for example less than 5% or 4% or 3% or 2% or 1% of aluminosilicate builder(s).

The detergent composition of the present invention may comprise less than 12% or 10%, for example less than 5% or 4% or 3% or 2% or 1% of phosphate builder.

The detergent composition may comprise at most 15% by weight of phosphate builder(s) and/or aluminosilicate builder(s) and/or silicate builder. For example the detergent composition may comprise from 0 to 12% by weight of phosphate builder(s) and/or aluminosilicate builder(s) and/or silicate builder.

The detergent composition may comprise less than 40%, in particular less than 30% or 20% or 20% or even less than 5% by weight of sodium chloride and/or of sodium sulfate and/or sodium carbonate.

The total amount of phosphate builder(s), aluminosilicate builder(s), polycarboxylic acid builder(s), and additional silicate builder(s) in the detergent composition may be comprised from 0 to 25%, or even from 1 to 20%, in particular from 1 to 15%, especially from 2 to 10%, for example from 3 to 5%, by weight.

The composition may further comprise any other supplemental builder(s), chelant(s), or, in general, any material which will remove calcium ions from solution by, for example, sequestration, complexation, precipitation or ion exchange. In particular the composition may comprise materials having at a temperature of 25° C. and at a 0.1M ionic strength a calcium binding capacity of at least 50 mg/g and a calcium binding constant log K $Ca^{2+}$ of at least 3.50.

In the composition of the invention, the total amount of phosphate builder(s), aluminosilicate builder(s), polycarboxylic acid builder(s), additional silicate builder(s), and other material(s) having a calcium binding capacity superior to 50 mg/g and a calcium binding constant higher than 3.50 in the composition may be comprised from 0 to 25%, or even from 1 to 20%, in particular from 1 to 15%, especially from 2 to 10%, for example from 3 to 5%, by weight.

Adjunct Components

The detergent composition may comprise additional adjunct components. The precise nature of these additional adjunct components, and levels of incorporation thereof, will depend on the physical form of the composition and the nature of the operation for which it is to be used. Suitable adjunct materials include, but are not limited to, flocculating aid, chelating agents, dye transfer inhibitors, enzymes, enzyme stabilizers, catalytic materials, bleach activators, hydrogen peroxide, sources of hydrogen peroxide, preformed peracids, polymeric dispersing agents, clay soil removal/anti-redeposition agents, brighteners, suds suppressors, dyes, perfumes, structure elasticizing agents, fabric softeners, carriers, hydrotropes, processing aids, and/or pigments. In addition to the disclosure below, suitable examples of such other adjuncts and levels of use are found in U.S. Pat. Nos. 5,576,282, 6,306,812 B1 and 6,326,348 B1 that are incorporated by reference. Such one or more adjuncts may be present as detailed below:

FLOCCULATING AID—The composition may further comprise a flocculating aid. Typically, the composition comprises at least 0.3% by weight of the composition of a flocculating aid. The composition may also be substantially free of flocculating aid. Typically, the flocculating aid is polymeric. Typically the flocculating aid is a polymer comprising monomer units selected from the group consisting of ethylene oxide, acrylamide, acrylic acid and mixtures thereof. Typically the flocculating aid is a polyethyleneoxide. Typically the flocculating aid has a molecular weight of at least 100,000 Da, in particular from 150,000 Da to 5,000,000 Da or even from 200,000 Da to 700,000 Da.

BLEACHING AGENT—The compositions of the present invention may comprise one or more bleaching agents. In general, when a bleaching agent is used, the compositions of the present invention may comprise from about 0.1% to about 50% or even from about 0.1% to about 25% bleaching agent by weight of the subject detergent composition. When present, suitable bleaching agents include bleaching catalysts, photobleaches for example Vitamin K3 and zinc or aluminium phtalocyanine sulfonate; bleach activators such as tetraacetyl ethylene diamine (TAED) and nonanoyloxybenzene sulfonate (NOBS); hydrogen peroxide; pre-formed peracids; sources of hydrogen peroxide such as inorganic perhydrate salts, including alkali metal salts such as sodium salts of perborate (usually mono- or tetra-hydrate), percarbonate, persulfate, perphosphate, persilicate salts and mixtures thereof, optionally coated, suitable coatings including inorganic salts such as alkali metal; and mixtures thereof.

The amounts of hydrogen peroxide source and peracid or bleach activator may be selected such that the molar ratio of available oxygen (from the peroxide source) to peracid is from 1:1 to 35:1, or even 2:1 to 10:1

FLUORESCENT WHITENING AGENT—The composition may contain components that may tint articles being cleaned, such as fluorescent whitening agent. When present, any fluorescent whitening agent suitable for use in a detergent composition may be used in the composition of the present invention. The most commonly used fluorescent whitening agents are those belonging to the classes of diaminostilbenesulfonic acid derivatives, diarylpyrazoline derivatives and bisphenyl-distyryl derivatives.

Typical fluorescent whitening agents are Parawhite KX, supplied by Paramount Minerals and Chemicals, Mumbai, India; Tinopal® DMS and Tinopal® CBS available from Ciba-Geigy AG, Basel, Switzerland. Tinopal® DMS is the disodium salt of 4,4'-bis-(2-morpholino-4anilino-s-triazin-6-ylamino) stilbene disulfonate. Tinopal® CBS is the disodium salt of 2,2'-bis-(phenyl-styryl)disulfonate.

FABRIC HUEING AGENTS—Fluorescent whitening agents emit at least some visible light. In contrast, fabric hueing agents alter the tint of a surface as they absorb at least a portion of the visible light spectrum. Suitable fabric hueing agents include dyes and dye-clay conjugates, and may also include pigments. Suitable dyes include small molecule dyes and polymeric dyes. Suitable small molecule dyes include small molecule dyes selected from the group consisting of dyes falling into the Colour Index (C.I.) classifications of Direct Blue, Direct Red, Direct Violet, Acid Blue, Acid Red, Acid Violet, Basic Blue, Basic Violet and Basic Red, or mixtures thereof.

POLYMERIC DISPERSING AGENTS—the compositions of the present invention can contain additional polymeric dispersing agents. These polymeric dispersing agents, if included, are typically at levels up to about 5%, typically from about 0.2% to about 2.5%, more typically from about 0.5% to about 1.5%. Suitable polymeric dispersing agents, include polymeric polycarboxylates, substituted (including quartemized and oxidized) polyamine polymers, and polyethylene glycols, such as: acrylic acid-based polymers having an average molecular of about 2,000 to about 10,000; acrylic/maleic-based copolymers having an average molecular weight of about 2,000 to about 100,000 and a ratio of acrylate to maleate segments of from about 30:1 to about 1:1; maleic/acrylic/vinyl alcohol terpolymers; polyethylene glycol (PEG) having a molecular weight of about 500 to about 100,000, typically from about 1,000 to about 50,000, more typically from about 1,500 to about 10,000; and water soluble or dispersible alkoxylated polyalkyleneamine materials.

POLYMERIC SOIL RELEASE AGENT—The compositions of the present invention can also contain polymeric soil release agent. polymeric soil release agent, or "SRA", have hydrophilic segments to hydrophilize the surface of hydrophobic fibers such as polyester and nylon, and hydrophobic segments to deposit upon hydrophobic fibers and remain adhered thereto through completion of washing and rinsing cycles, thereby serving as an anchor for the hydrophilic segments. This can enable stains occurring subsequent to treatment with the SRA to be more easily cleaned in later washing procedures. Preferred SRA's include oligomeric terephthalate esters; sulfonated product of a substantially linear ester oligomer comprised of an oligomeric ester backbone of terephthaloyl and oxyalkyleneoxy repeat units and allyl-derived sulfonated terminal moieties covalently attached to the backbone; nonionic end-capped 1,2-propylene/polyoxyethylene terephthalate polyesters; an oligomer having empirical formula $(CAP)_2$ $(EG/PG)_5$ $(T)_5$ $(SIP)_1$ which comprises terephthaloyl (T), sulfoisophthaloyl (SIP), oxyethyleneoxy and oxy-1,2-propylene (EG/PG) units and which is typically terminated with end-caps (CAP), typically modified isethionates, as in an oligomer comprising one sulfoisophthaloyl unit, 5 terephthaloyl units, oxyethyleneoxy and oxy-1,2-propyleneoxy units in a defined ratio, typically about 0.5:1 to about 10:1, and two-end-cap units derived from sodium 2-(2-hydroxyethoxy)-ethanesulfonate; oligomeric esters comprising: (1) a backbone comprising (a) at least one unit selected from the group consisting of dihydroxy sulfonates, polyhydroxy sulfonates, a unit which is at least trifunctional whereby ester linkages are formed resulting in a branched oligomer backbone, and combinations thereof; (b) at least one unit which is a terephthaloyl moiety; and (c) at least one unsulfonated unit which is a 1,2-oxyalkyleneoxy moiety; and (2) one or more capping units selected from nonionic capping units, anionic capping units such as alkoxylated, typically ethoxylated, isethionates, alkoxylated propanesulfonates, alkoxylated propanedisulfonates, alkoxylated phenolsulfonates, sulfoaroyl derivatives and mixtures thereof. Preferred are esters of the empirical formula:

$$((CAP)_a(EG/PG)_b(DEG)_cPEG)_d(T)_e(SIP)_f(SEG)_g(B)_h)$$

wherein CAP, EG/PG, PEG, T and SIP are as defined hereinabove, DEG represents di(oxyethylene)oxy units, SEG represents units derived from the sulfoethyl ether of glycerin and related moiety units, B represents branching units which are at least trifunctional whereby ester linkages are formed resulting in a branched oligomer backbone, a is from about 1 to about 12, b is from about 0.5 to about 25, c is from 0 to about 12, d is from 0 to about 10, b+c+d totals from about 0.5 to about 25, e is from about 1.5 to about 25, f is from 0 to about 12; e+f totals from about 1.5 to about 25, g is from about 0.05 to about 12; h is from about 0.01 to about 10, and a, b, c, d, e, f, g, and h represent the average number of moles of the corresponding units per mole of the ester; and the ester has a molecular weight ranging from about 500 to about 5,000.; and; cellulosic derivatives such as the hydroxyether cellulosic polymers available as METHOCEL® from Dow; the $C_1$-$C_4$ alkyl celluloses and $C_4$ hydroxyalkyl celluloses, see U.S. Pat. No. 4,000,093, issued Dec. 28, 1976 to Nicol et al., and the methyl cellulose ethers having an average degree of substitution (methyl) per anhydroglucose unit from about 1.6 to about 2.3 and a solution viscosity of from about 80 to about 120 centipoise measured at 20° C. as a 2% aqueous solution. Such materials are available as METOLOSE SM100® and METOLOSE SM200®, which are the trade names of methyl cellulose ethers manufactured by Shinetsu Kagaku Kogyo KK.

ENZYME—The composition of the invention may further comprise an enzyme. When present in the detergent composition, the enzymes may be present at levels from about 0.00001% to about 2%, from about 0.0001% to about 1% or even from about 0.001% to about 0.5% or 0.02% enzyme protein by weight of the composition.

Examples of suitable enzymes include, but are not limited to, hemicellulases, peroxidases, proteases, cellulases, xylanases, lipases, phospholipases, esterases, cutinases, pectinases, mannanases, pectate lyases, keratinases, reductases, oxidases, phenoloxidases, lipoxygenases, ligninases, pullulanases, tannases, pentosanases, malanases, β-glucanases, arabinosidases, hyaluronidase, chondroitinase, laccase, and amylases, or mixtures thereof.

ENZYME STABILIZERS—Enzymes for use in detergents can be stabilized by various techniques. The enzymes employed herein can be stabilized by the presence of water-soluble sources of calcium and/or magnesium ions in the finished compositions that provide such ions to the enzymes. In case of aqueous compositions comprising protease, a reversible protease inhibitor, such as a boron compound, can be added to further improve stability.

CATALYTIC METAL COMPLEXES—The compositions of the invention may comprise catalytic metal complexes. When present, one type of metal-containing bleach catalyst is a catalyst system comprising a transition metal cation of defined bleach catalytic activity, such as copper, iron, titanium, ruthenium, tungsten, molybdenum, or manganese cations, an auxiliary metal cation having little or no bleach catalytic activity, such as zinc or aluminum cations, and a sequestrate having defined stability constants for the catalytic and auxiliary metal cations, particularly ethylenediaminetetraacetic acid, ethylenediaminetetra(methylenephosphonic acid) and water-soluble salts thereof. Such catalysts are disclosed in U.S. Pat. No. 4,430,243.

If desired, the compositions herein can be catalyzed by means of a manganese compound. Such compounds and levels of use are well known in the art and include, for example, the manganese-based catalysts disclosed in U.S. Pat. No. 5,576,282.

Cobalt bleach catalysts useful herein are known, and are described, for example, in U.S. Pat. No. 5,597,936; U.S. Pat. No. 5,595,967. Such cobalt catalysts are readily prepared by known procedures, such as taught for example in U.S. Pat. No. 5,597,936, and U.S. Pat. No. 5,595,967.

Compositions herein may also suitably include a transition metal complex of ligands such as bispidones (WO 05/042532 A1) and/or macropolycyclic rigid ligands—abbreviated as "MRLs". As a practical matter, and not by way of limitation, the compositions and processes herein can be adjusted to provide on the order of at least one part per hundred million of the active MRL species in the aqueous washing medium, and will typically provide from about 0.005 ppm to about 25 ppm, from about 0.05 ppm to about 10 ppm, or even from about 0.1 ppm to about 5 ppm, of the MRL in the wash liquor.

Suitable transition-metals in the instant transition-metal bleach catalyst include, for example, manganese, iron and chromium. Suitable MRLs include 5,12-diethyl-1,5,8,12-tetraazabicyclo[6.6.2]hexadecane.

Suitable transition metal MRLs are readily prepared by known procedures, such as taught for example in WO 00/32601, and U.S. Pat. No. 6,225,464.

SOFTENING SYSTEM—the compositions of the invention may comprise a softening agent such as clay for softening through the wash. The composition may additionally comprise a charged polymeric fabric-softening boosting component.

COLORANT—the compositions of the invention may comprise a colorant, typically a dye or a pigment. Particularly, preferred dyes are those which are destroyed by oxidation during a laundry wash cycle. To ensure that the dye does not decompose during storage it is preferable for the dye to be stable at temperatures up to 40° C. The stability of the dye in the composition can be increased by ensuring that the water content of the composition is as low as possible. If possible, the dyes or pigments should not bind to or react with textile fibres. If the colorant does react with textile fibres, the colour imparted to the textiles should be destroyed by reaction with the oxidants present in laundry wash liquor. This is to avoid coloration of the textiles, especially over several washes. Particularly, preferred dyes include but are not limited to Basacid® Green 970 from BASF and Monastral blue from Albion.

Detergent Composition

The detergent composition is typically a laundry detergent composition or a dish washing detergent composition. Typically, the composition is a laundry composition.

The detergent composition may comprise a solvent. Suitable solvents include water and other solvents such as lipophilic fluids. Examples of suitable lipophilic fluids include siloxanes, other silicones, hydrocarbons, glycol ethers, glycerine derivatives such as glycerine ethers, perfluorinated amines, perfluorinated and hydrofluoroether solvents, low-volatility nonfluorinated organic solvents, diol solvents, other environmentally-friendly solvents and mixtures thereof.

The detergent composition is for example in particulate form, typically in free-flowing particulate form, although the composition may be in any liquid or solid form. The composition in solid form can be in the form of an agglomerate, granule, flake, extrudate, bar, tablet or any combination thereof. The solid composition can be made by methods such as dry-mixing, agglomerating, compaction, spray drying, pan-granulation, spheronization or any combination thereof. The solid composition typically has a bulk density of from 300 g/l to 1,500 g/l, typically from 500 g/l to 1,000 g/l.

The detergent composition may also be in the form of a liquid, gel, paste, dispersion, typically a colloidal dispersion or any combination thereof. Liquid compositions typically have a viscosity of from 500 mPa·s to 3,000 mPa·s, when measured at a shear rate of 20 $s^{-1}$ at ambient conditions (20° C. and 1 atmosphere), and typically have a density of from 800 g/l to 1300 g/l. If the composition is in the form of a dispersion, then it will typically have a volume average particle size of from 1 micrometer to 5,000 micrometers, typically from 1 micrometer to 50 micrometers. Typically, a Coulter Multisizer is used to measure the volume average particle size of a dispersion.

The detergent composition may be in unit dose form, including not only tablets, but also unit dose pouches wherein the composition is at least partially enclosed, typically completely enclosed, by a film such as a polyvinyl alcohol film.

The detergent composition may also be in the form of an insoluble substrate, for example a non-woven sheet, impregnated with detergent actives.

The detergent composition may be capable of cleaning and/or softening fabric during a laundering process. Typically, the detergent composition is formulated for use in an automatic washing machine or for hand-washing use.

The following examples are given by way of illustration only and therefore should not be construed to limit the scope of the invention.

EXAMPLES

| Ingredients | Example 1 | Example 2 | Example 3 |
|---|---|---|---|
| | Concentration (weight percent) | | |
| LAS | 12 | 15-18 | 9 |
| Mixture of alkyl sulfate surfactants[1] | 1.5 | 1.5-2 | 1.5 |
| Cationic surfactant | 0-1 | 0-1.5 | 0-1 |
| Non ionic surfactant | 0-1 | 0-1.5 | 0-1 |
| Phosphate builder(s) | 0-3 | 2-5 | 3 |
| Zeolite | 0-3 | 6-10 | 0-3 |
| Polymeric dispersing or soil release agent(s) | 1-3 | 1-4 | 1-3 |
| Bleach and bleach activator | 0-5 | 4-6 | 2-3 |
| silicate | 7-9 | | 5-6 |
| carbonate | 10-30 | 25-35 | 15-30 |
| Sulfate | 30-70 | 30-35 | 40-70 |

[1]a mixture of alkyl sulfate surfactant having one of the two following chain length distribution (weight percentage):

| | C12 | C14 | C16 | C18/higher |
|---|---|---|---|---|
| Mixture 1 | 65% | 25% | 7% | 3% |
| Mixture 2 | 70% | 30% | | |

Unless indicated otherwise, all percentage and ratio are in weight.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A detergent composition comprising:

at most about 15% by weight of one or more builders selected from the group consisting of phosphate builders, aluminosilicate builders, polycarboxylic acid builders, and additional silicate builders; and at least one sulfate or sulfonate anionic surfactant, each sulfate or sulfonate anionic surfactant in the detergent composition being selected from the group consisting of:

(i) an alkyl sulfate surfactant consisting of molecules having formula $R_1$—O—$SO_3^-M^+$, such that from about 85% to about 100% by weight of the molecules having formula $R_1$—O—$SO_3^-M^+$ in the detergent composition are molecules having formula $R_3$—O—$SO_3^-M^+$;

(ii) an alkyl phenyl sulfonate surfactant consisting of molecules having formula $R_2$-Ph-$SO_3^-M^+$, such that from about 75% to about 100% by weight of the molecules having formula $R_2$-Ph-$SO_3^-M^+$in the detergent composition are molecules having formula $R_4$-Ph-$SO_3^-M^+$;

(iii) an alkyl sulfonate surfactant consisting of molecules having formula $R_1$—$SO_3^-M^+$, such that from about 85% to about 100% by weight of the molecules having formula $R_1$—$SO_3^-M^+$in the detergent composition are molecules having the formula $R_3$—$SO_3^-M^+$; and (iv) mixtures of any of these, where:

each $R_1$ is a linear or branched, substituted or unsubstituted, optionally alkoxylated, $C_8$-$C_{18}$ alkyl group;

each $R_2$ is a linear or branched, substituted or unsubstituted, optionally alkoxylated, $C_8$-$C_{15}$ alkyl group;

each $R_3$ is a linear or branched, substituted or unsubstituted, optionally alkoxylated, $C_8$-$C_{15}$ alkyl group;

each $R_4$ is a linear or branched, substituted or unsubstituted, optionally alkoxylated, $C_8$-$C_{12}$ alkyl group;

each $M^+$, identical or different, is a proton or a cation that provides charge neutrality; and Ph is a phenyl group, optionally substituted.

2. The detergent composition of claim 1, wherein the at least one sulfate or sulfonate anionic surfactant consists of at least one of said alkyl sulfate surfactant.

3. The detergent composition of claim 1, wherein the at least one sulfate or sulfonate anionic surfactant consists of at least one of said alkyl phenyl sulfonate surfactant.

4. The detergent composition of claim 1, wherein the at least one sulfate or sulfonate anionic surfactant consists of at least one of said alkyl sulfonate surfactant.

5. The detergent composition of claim 1, comprising from 1% to 15% by weight of said one or more builders.

6. A detergent composition comprising:

at most about 15% by weight of one or more builders selected from the group consisting of phosphate builders, aluminosilicate builders, polycarboxylic acid builders, and additional silicate builders; and at least one alkyl sulfate surfactant, each alkyl sulfate surfactant in the detergent composition consisting of molecules having formula $R_1$—O—$SO_3^-M^+$, such that from about 85% to about 100% by weight of the molecules having formula $R_1$—O—$SO_3^-M^+$in the detergent composition are molecules having formula $R_3$—O—$SO_3^-M^+$, and from 50% to 99% by weight of the molecules having formula $R_1$—O—$SO_3^-M^+$in the detergent composition are molecules having formula $R_{12}$—O—$SO_3^-M^+$, where:

each $R_1$ is a linear or branched, substituted or unsubstituted, optionally alkoxylated, $C_8$-$C_{18}$ alkyl group;

each $R_3$ is a linear or branched, substituted or unsubstituted, optionally alkoxylated, $C_8$-$C_{15}$ alkyl group;

each $R_{12}$ is a linear or branched, substituted or unsubstituted, optionally alkoxylated, $C_{12}$ alkyl group;

each $M^+$, identical or different, is a proton or a cation that provides charge neutrality; and Ph is a phenyl group, optionally substituted.

7. The detergent composition of claim 6, comprising from 1% to 15% by weight of said one or more builders.

8. The detergent composition of claim 6, wherein from 60% to 95% by weight of the molecules having formula $R_1—O—SO_3^-M^+$ in the detergent composition are molecules having formula $R_{12}—O—SO_3^-M^+$.

9. The detergent composition of claim 6, wherein from 70% to 80% by weight of the molecules having formula $R_1—O—SO_3^-M^+$ in the detergent composition are molecules having formula $R_{12}—O—SO_3^-M^+$.

10. The detergent composition of claim 6, wherein of all groups $R^1$ in said molecules having formula $R_1—O—SO_3^-M^+$ in said at least one alkyl sulfate surfactant, 70% of said groups $R^1$ are $C_{12}$ alkyl groups and 30% of said groups $R^1$ are $C_{14}$ alkyl groups.

11. The detergent composition of claim 10, wherein said detergent composition comprises from 1.5% to 2% by weight of said at least one alkyl sulfate surfactant.

12. The detergent composition of claim 6, wherein of all groups $R^1$ in said molecules having formula $R_1—O—SO_3^-M^+$ in said at least one alkyl sulfate surfactant, 65% of said groups $R^1$ are $C_{12}$ alkyl groups, 25% of said groups $R^1$ are $C_{14}$ alkyl groups, 7% of said groups $R^1$ are $C_{16}$ alkyl groups, and 3% of said groups $R^1$ are $C_{18}$ alkyl groups.

13. The detergent composition of claim 12, wherein said detergent composition comprises from 1.5% to 2% by weight of said at least one alkyl sulfate surfactant.

14. The detergent composition of claim 6, wherein a total of from 10% to 99% by weight of all alkyl sulfate surfactants in the detergent composition are alkoxylated alkyl sulfate surfactants.

15. The detergent composition of claim 14, wherein said at least one alkyl sulfate surfactant comprises at least two alkoxylated alkyl sulfate surfactants each having different degrees of alkoxylation.

16. The detergent composition of claim 15, wherein said at least two alkoxylated alkyl sulfate surfactants each are alkoxylated with from 0.1 to 9 moles of $C_{1-4}$ alkylene oxide per mole of alkyl sulfate surfactant.

17. The detergent composition of claim 15, wherein said at least two alkoxylated alkyl sulfate surfactants each are alkoxylated with from 0.3 to 1.5 moles of $C_{1-4}$ alkylene oxide per mole of alkyl sulfate surfactant.

* * * * *

UNITED STATES PATENT AND TRADEMARK OFFICE

CERTIFICATE OF CORRECTION

PATENT NO. : 7,910,538 B2
APPLICATION NO. : 12/477962
DATED : March 22, 2011
INVENTOR(S) : Ming Tang et al.

It is certified that error appears in the above-identified patent and that said Letters Patent is hereby corrected as shown below:

Column 7

Line 57, delete "quartemized" and insert -- quarternized --.

Signed and Sealed this
Sixth Day of March, 2012

David J. Kappos

David J. Kappos
*Director of the United States Patent and Trademark Office*